US005560657A

United States Patent [19]

Morgan

[11] Patent Number: 5,560,657

[45] Date of Patent: Oct. 1, 1996

[54] TAMPER-INDICATING LABEL

[76] Inventor: Brian R. Morgan, 2641 Calle Del Oro, La Jolla, Calif. 92037

[21] Appl. No.: 401,021

[22] Filed: Mar. 8, 1995

[51] Int. Cl.[6] ..... G09F 3/10

[52] U.S. Cl. ..... 283/80; 283/81; 40/299

[58] Field of Search ..... 283/74, 75, 79, 283/80, 81, 94, 56, 900; 40/299, 6

[56] References Cited

U.S. PATENT DOCUMENTS

| | | | |
|---|---|---|---|
| 164,800 | 6/1875 | Brooks . | |
| 372,653 | 11/1887 | Boughton . | |
| 381,326 | 4/1888 | Brooks . | |
| 777,749 | 12/1904 | Russell . | |
| 822,945 | 6/1906 | Harris . | |
| 1,615,057 | 1/1927 | Tyden . | |
| 1,814,773 | 7/1931 | Stillman . | |
| 1,952,085 | 3/1934 | Mayer | 40/2.2 |
| 2,002,856 | 5/1935 | Hope | 292/318 |
| 2,013,299 | 9/1935 | Byrne | 292/307 |
| 2,497,434 | 2/1950 | Borland | 292/317 |
| 3,994,085 | 11/1976 | Groselak et al. | 283/80 X |
| 4,112,603 | 9/1978 | Giule | 283/80 X |
| 5,379,538 | 1/1995 | Osborne | 40/299 |

FOREIGN PATENT DOCUMENTS

| | | |
|---|---|---|
| 2306137 | 3/1976 | France . |
| 105481 | 7/1898 | Germany . |
| 642806 | 10/1960 | Italy . |
| 273289 | 6/1927 | United Kingdom . |
| 342172 | 2/1930 | United Kingdom . |
| 2051942 | 6/1980 | United Kingdom . |
| 2243139 | 3/1990 | United Kingdom . |

*Primary Examiner*—Willmon Fridie, Jr.

*Attorney, Agent, or Firm*—Brown, Martin, Haller & McClain

[57] ABSTRACT

A tamper indicating label is made of tear-resistant paper material which is cut to form an enlarged base area and an elongate tongue projecting from the base area. The base area has a signature area imprinted on its front face, and is at least partially coated with adhesive material on its rear face. The tongue is threaded through eyelets on two parts of a closure of a container or the like to be protected, and the projecting end portion of the tongue is placed against the adhesive coating of the base area while the base area is folded about a central fold line dividing the base area into two halves, and the two halves are pressed against each other with the adhesive layer innermost and the projecting end portion of the tongue trapped between the two halves.

16 Claims, 2 Drawing Sheets

TAMPER-INDICATING LABEL

BACKGROUND OF THE INVENTION

The present invention relates generally to tamper-indicating devices for providing evidence of tampering or opening of various types of containers or enclosures for containing valuables, private information or the like, such as luggage, briefcases, jewelry boxes, folders, filing cabinets, desk drawers and the like.

Most security devices for locking luggage, briefcases, filing cabinets and the like have the disadvantage that an individual may be able to unlock and subsequently relock the device without the owner's knowledge, leaving no evidence that an unauthorized individual has had access to the item which was secured. This is a particular problem in the case of secured secret or sensitive information. Additionally, when only a limited number of individuals have access to an enclosure containing valuables, it would be desirable if evidence of opening of the enclosure was immediately apparent. Such immediately visible evidence would also provide a deterrent to unauthorized individuals opening such containers or enclosures.

Security seals are known for sealing across the base and lid of a container, suitcase, briefcase or the like or across the opening of a folder, for example. One such seal is described in U.S. Pat. No. 2,013,299 of Byrne, in which an adhesive backed paper label bearing an authorized signature is adhered across the junction between the lid and base of a box or case. Thus, the box or case cannot be opened without removing or tearing the label. However, this arrangement has the disadvantage that the strip must be torn off each time the authorized owner wants to open the case, and part of the label and the adhesive may remain adhered to the surface of the case, detracting from its appearance. The adhesive used must be strong enough such that the label cannot be easily peeled off and re-adhered, and thus the label is difficult to remove even when the authorized user wishes to open the case.

SUMMARY OF THE INVENTION

It is an object of the present invention to provide a new and improved tamper indicating label or tag for containers, cases and the like.

According to the present invention, a tamper indicating label is provided, which comprises a sheet of tear-resistant paper material cut to form an enlarged base area and an elongate tongue of width less than that of the base area projecting from the base area, the tongue having a free end, the paper sheet having a front face with imprinted indicia defining a signature receiving region in the base area, a rear face, and a fold line extending across the base area to divide the base area into two halves, an adhesive layer covering at least one half of the base area on the rear face of the sheet, whereby the tongue may be extended through two eyelets or the like on different parts of a case or enclosure to be secured, the free end of the tongue may be placed against one half of the rear face of the base area, and the base area may be folded about the fold line with the rear face innermost so that one half adheres to the other half with the end of the tongue held between the two halves. The user can place their signature in the signature area on the front face.

This arrangement will provide an immediate indication of unauthorized opening of a case or container. The paper is preferably of tear resistant paper such as Tyvek® of Dupont or other types of paper impregnated with vinyl, resin, latex or the like, which are generally used for tear resistant packaging material and the like. These types of paper are also water-resistant. Thus, the label or tag cannot easily be torn off and will not normally be torn off accidentally. The tongue must normally be cut in order to remove the label and allow the enclosure or case to be opened. This will also destroy the label, and an unauthorized individual will not normally be able to duplicate the user's signature on a new label, so that the user or owner can easily determine if the case or enclosure has been opened in his or her absence.

Preferably, the adhesive layer covers the entire rear face of the base area and also extends partially along the tongue. This provides a stronger tag since the overlying tongue portion can be adhered to the adhesive coated tongue portion, in addition to the folded halves of the base area. A peel-off cover layer preferably covers the adhesive layer and can be peeled off by the user before application of the label to a container or enclosure to be protected.

Eyelets may also be provided in the same tear-resistant paper material for use on luggage, cases, furniture or the like which do not already have suitable eyelets or the like. The eyelets will also be backed with an adhesive layer for application to one part of a container to be secured, and may have destructive tear slits so that the eyelets cannot easily be removed without tearing. Alternatively, the eyelets may be of plastic with an adhesive backing tape layer of slightly larger dimensions than the plastic eyelet, forming a rim surrounding the eyelet. The backing tape secures the eyelet to a selected surface. The backing tape cannot be removed after adhering it to a surface without distorting the projecting rim, making any removal and replacement of the eyelet immediately apparent.

Preferably, the signature area is provided on one half of the front face of the label, on one side of the fold line, and an address area for receiving a user's address may be imprinted on the other half of the front face, so that the label can act as a luggage identification tag as well as a security device.

The tamper indicating label may be used with any container or item having a movable closure for closing an enclosed area, such as a suitcase, briefcase, bag, folder, and the drawers of desks, filing cabinets, dressers, diaries, and the like. If the container does not have any appropriate eyelets, such as zippers or rings for receiving locking devices as are often provided on suitcases and the like, eyelets may be applied appropriately to adjacent surfaces on opposite sides of a closure of the item. The tamper indicating label is quick, convenient and easy to use, and a user can buy a large supply for use as needed at relatively low cost. Once the label is applied, access to the enclosed area, such as the inside of a case or drawer, or luggage and travel cases cannot be obtained without removing the label, which inherently destroys the label. A new label cannot then be applied by an unauthorized individual since they will normally be unable to reproduce the owner's signature with sufficient accuracy. This device therefore provides an effective deterrent to unauthorized tampering with items containing sensitive information or valuable objects.

BRIEF DESCRIPTION OF THE DRAWINGS

The present invention will be better understood from the following detailed description of some preferred embodiments of the invention, taken in conjunction with the accompanying drawings, in which like reference numerals refer to like parts, and in which.

DESCRIPTION OF THE PREFERRED EMBODIMENT

Figure 1:
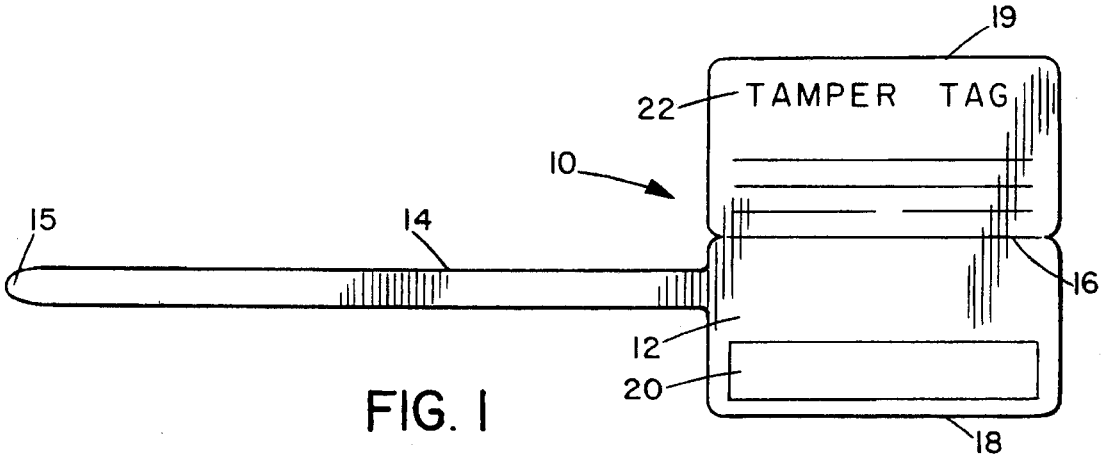
FIG. 1 is a front view of a basic configuration of the tag or label according to a first embodiment of the invention, with the tag in the open position before use.
Figure 2:
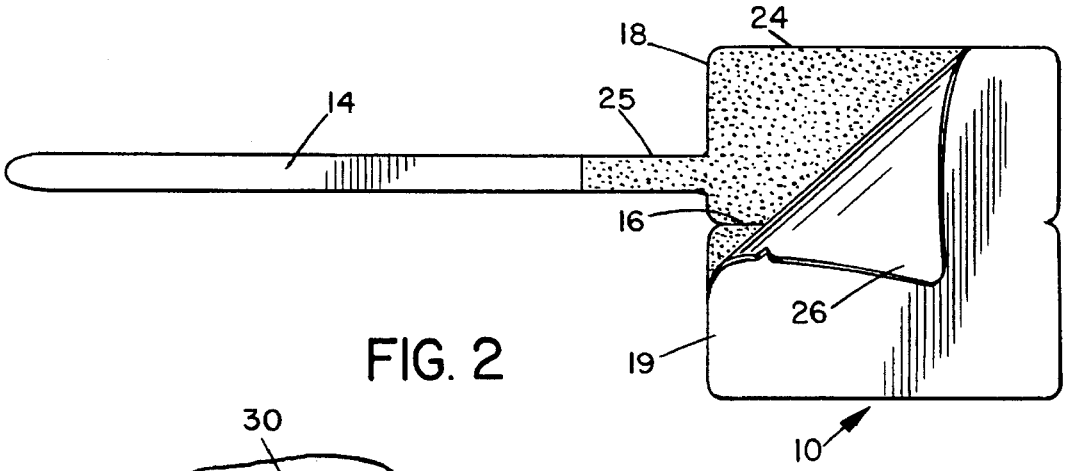
FIG. 2 is a rear view of the tag with the backing partially peeled away from the adhesive.
Figure 3:
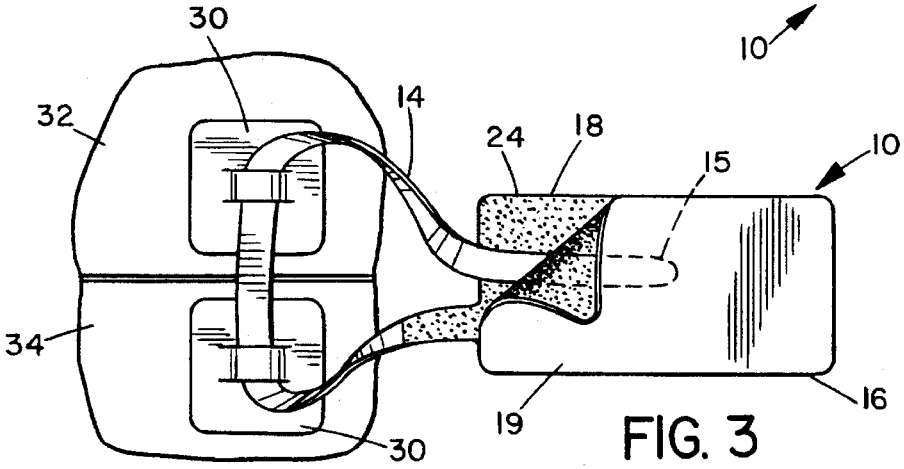
FIG. 3 illustrates the tag threaded through a pair of eyelets and being adhesively secured.

FIGS. 1–3 of the drawings illustrate a tamper indicating tag or label 10 for securing luggage and other types of containers according to a first embodiment of the invention. The label 10 basically comprises a sheet of tear-resistant paper material cut to form an enlarged base area 12 and an elongate tongue 14 of width substantially less than that of the base area and projecting from the base area up to free end 15. The base area 12 is generally rectangular or square and has a central fold line 16 about which the base area may be folded and which divides the base area into two halves 18,19. Imprinted indicia 20 in one half of the front face of the base area define a signature area for receiving a user's signature. Imprinted indicia 22 in the other half define an address area for receiving a user's name and address. The rear face of the base area is coated with an adhesive layer 24. Layer 24 preferably also extends partially along the tongue, as illustrated at 25 in FIG. 2. The adhesive layer 24 is covered with a cover layer 26 of paper or the like which may be peeled away as illustrated in FIG. 2 when the tamper label is to be applied to a container or the like.

The paper material may be any one of a number of strong papers impregnated with various materials for tear-resistance. One suitable paper is Tyvek® of Dupont, which is used for Registered Mail envelopes and packages and is both tear-resistant and water-resistant. Any type of paper impregnated with vinyl, resin, latex, polyolefin or other polycomposite materials may be suitable. Alternatively, white chrome-coated paper, as made by all major paper manufacturing companies, may be used.

Figure 7:
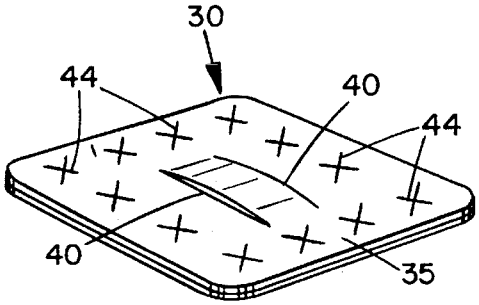
FIG. 7 is a perspective view of an eyelet for use with the tags.
Figure 8:
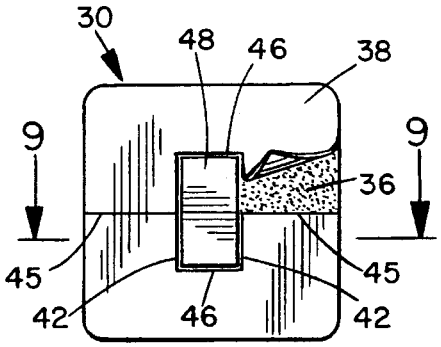
FIG. 8 is a rear view of the eyelet with the backing partially peeled away.
Figure 9:
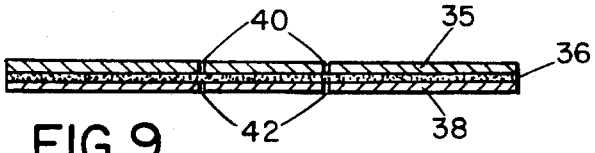
FIG. 9 is an enlarged sectional view taken on line 9—9 of FIG. 8.

The label 10 may be used in conjunction with any container having a movable closure for closing a space containing valuable items or sensitive materials. All that is needed is an appropriate eyelet on each side of the closure. Some containers, such as luggage, briefcases and the like, will already have appropriate eyelets or zipper end tags which may be used, as described, for example, in U.S. Patent Application No. 08/133,556 filed Oct. 7, 1993. Other containers, such as the drawers of desks, filing cabinets or the like, or folders, as well as some cases and bags, have no such eyelets. In this case, a pair of eyelets 30 as illustrated in FIGS. 7–9 may be applied on opposite sides 32,34 of a closure, as generally illustrated in FIG. 3. The sides 32,34 may comprise the lid and base of a case or box, a drawer and the frame surrounding the drawer, a door and door frame, or the like.

Each eyelet 30 comprises a layer 35 of the same type of tear-resistant paper material as label 10, an adhesive layer 36, and a backing or liner sheet 38. A pair of parallel die cut slits 40 are formed in layer 35, and corresponding slits 42 aligned with the slits 40 extend through liner sheet 38 and the adhesive layer. Additional destructive die cuts or slits 44 are cut in the face layer 35 only. Die cuts 45 extend transversely up to slits 42 in the liner sheet only, and die cuts 46 extend between the ends of slits 42 to leave a central area 48 of the liner sheet covering the adhesive layer 36 when the remainder of the sheet is peeled away, as generally indicated in FIG. 8.

The adhesive used will be relatively aggressive so that an eyelet cannot easily be removed after application to a container or item to be secured. When a tamper indicating tag or label 10 is to be used to secure an item having a movable closure which does not already have any appropriate loops, eyelets or openings, eyelets 30 are first applied on opposite sides of the opening, as generally illustrated in FIG. 3. The backing sheet 38 is first peeled away as illustrated in FIG. 8, along slits 45,42 and 46, leaving the central area 48 of the backing sheet underlying eyelet slits 40 and covering the adhesive in this area. The eyelet 30 is then adhered to one part 32 of a container or other closure to be protected via adhesive layer 36 surrounding central area 48, which does not adhere to the underlying surface. A second eyelet 30 is applied to the other part in an equivalent manner.

Once the eyelets 30 have been applied, an appropriate signature is applied to the label 10 in area 20, and the backing layer 26 is peeled away as illustrated in FIG. 2. The end 15 of the tongue is inserted through slits 40 in both eyelets, as illustrated in FIG. 3, extending beneath the central area 48 of the backing layer which is not adhered to the surface. The base area is then folded inwardly along fold line 16 with the adhesive layer innermost and the signature carrying face of the label outermost, and the free end 15 of the tongue is placed on one half of the adhesive layer. The other half is then pressed down against the first half, adhering the two halves firmly together with an end portion of the tongue held between them, as generally illustrated in FIG. 3. Part of the tongue may also be adhered to the extended adhesive portion 25 on the underlying tongue portion adjacent the base area, providing additional security. Extended portion 25 preferably extends to a length of between ⅓ to ½ of the total length of the tongue 14. The fold line 16 is preferably an imprinted line on the base area, so that the user can see exactly where to form the fold.

With this arrangement, part 32 cannot be moved away from part 34 without either removing the label or removing one of the eyelets. The paper material used in label 10 is tear resistant, so that neither the base area nor the tongue can be torn, and must be cut in order to release the tongue from the eyelets. The eyelets 30 are also tear resistant and strongly adhered to the underlying surface. Any attempt to peel off one of the eyelets 30 will result in destruction of the eyelet, which will tend to tear along destructive tear slits 44. Thus, the eyelet cannot be removed to allow the container or the like to be opened without destroying the eyelet, so it cannot be re-adhered. The tearing of the eyelet as a result of any such attempt will be immediately apparent.

It will be understood that the tongue may alternatively be threaded through existing eyelets, rings, zipper end tags or the like provided on a suitcase or briefcase, if suitable eyelets or rings are already present.

Figure 11:
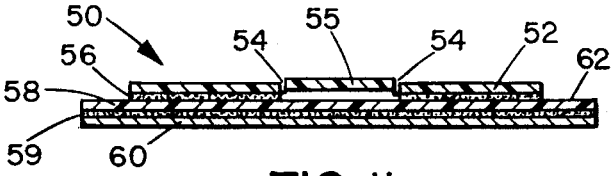
FIG. 11 is an enlarged sectional view on the lines 11—11 of FIG. 10.
Figure 10:
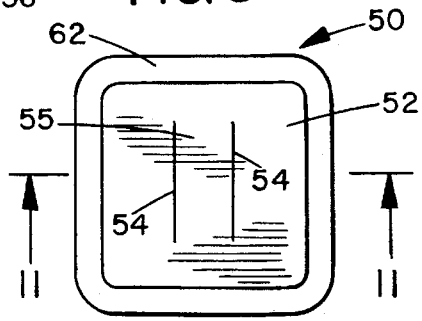
FIG. 10 is a front view of an alternative eyelet for use with the tags.

FIGS. 10 and 11 illustrate an alternative eyelet 50 which may be used in place of eyelets 30. Eyelet 50 basically comprises a relatively thin, plastic tag 52 with a pair of raised eyelet slits 54 on opposite sides of eyelet strip 55, a backing layer 56 of adhesive, a sheet of transparent film or tape 58 adhered via adhesive layer 56 to the undersurface of plastic tag 52, a further layer 59 of adhesive, and a peel-off paper or liner layer 60. Tape 58 may be a double-sided adhesive tape, for example. Tape or film sheet 58 is of larger dimensions than plastic tag 52, so that it forms a rim or halo 62 surrounding the tag, as best illustrated in FIG. 10. Indicia may be imprinted in the film 58 around rim 62, if desired.

Eyelet 50 may be applied to any surface, such as leather, plastic, wood, metal or the like, adjacent a closure, in a similar manner to eyelet 30. Backing layer 60 is first peeled off, and the eyelet is pressed against the surface at an appropriate position with the plastic eyelet tag outermost. Tongue 14 of a tamper indicating label may then be inserted through slits 54 and beneath eyelet strip 48, in the manner illustrated in FIG. 3, and through the eyelet slits of another eyelet 50 on a surface of another part of a container adjacent the closure. Once the label is secured, the container cannot be opened without cutting the label or removing one of the eyelets. The eyelets will be adhered firmly to the underlying surface and cannot be easily peeled off. Any attempts to disturb or peel up film 58 at the edge of rim 62 will result in compression and distortion of the rim, which cannot then be re-adhered in the same flat condition. Any indicia imprinted around the rim will also become distorted, providing a further indication that the eyelet has been disturbed.

Eyelets 30 and 50 may also be used with the tamper indicating device as described in my co-pending Continuation-In-Part application filed on even date herewith, entitled "Tamper Evident Security Device," which is a Continuation-In-Part of Application Ser. No. 08/133,556 filed on Oct. 7, 1993, and the contents of both these pending applications are incorporated herein by reference.

Thus, any attempt to circumvent the label 10 when applied as illustrated in FIG. 3 using eyelets 30 or 50, or existing eyelets on a suitcase, briefcase or the like as described in my co-pending application referred to above, will fail. The strength of the paper used for the label 10 is such that it cannot be torn accidentally, for example, and will not be destroyed by water. Anyone attempting to remove the label will be unable to tear it, and will have to cut the tongue 14 in order to remove the label, after which the same label cannot be reapplied. Any attempt to remove eyelet 30 will result in tearing of the eyelet so that it cannot be reapplied. Any attempt to remove an eyelet 50 will result in distortion of rim 62, so that it also cannot be reapplied in its original condition. Thus, unauthorized individuals cannot circumvent the label 10. A new label cannot be applied by an unauthorized user, since they will not normally be able to reproduce the user's signature. Thus, an unauthorized opening of the protected container cannot be concealed.

When the authorized user wishes to obtain access to the container, they simply cut across tongue 14. When the container is re-closed, they simply apply a new label in the same manner, inserting a signature in area 20 and thus providing a deterrent to unauthorized user's opening the container.

Figure 4:
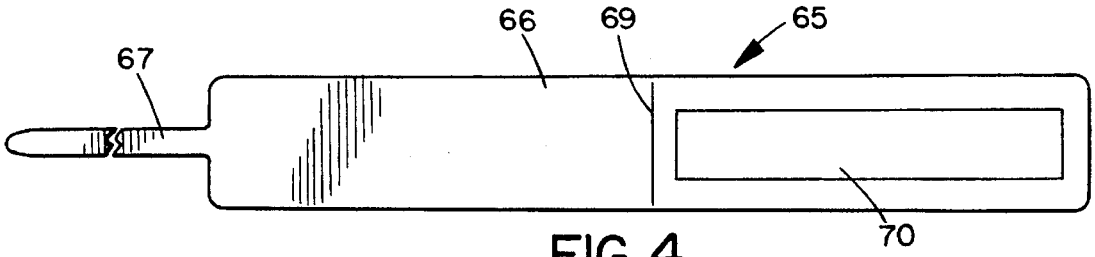
FIG. 4 is a front view of an alternative configuration with end folding.

FIG. 4 illustrates a similar tamper indicating label or tag 65 to label 10, but with a different configuration in base area 66. As in the first embodiment, label 65 is of tear-resistant paper material cut to form a base area and elongated tongue 67 extending from the base area. However, the base area 66 is of different shape from base area 12 of the previous embodiment, and comprises an elongated, strip-like shape with the tongue 67 projecting from one end of the base area 66. A transverse fold line 69 is provided in the center of area 66, and a signature area 70 is imprinted on one half of the base area 66 on one side of fold line 69. As in the first embodiment, the base area 66 has a backing layer of adhesive with a paper cover layer (not illustrated), which may be peeled away to expose the adhesive when the label is ready for use. As in the first embodiment, the user applies a signature in area 66, inserts tongue 67 through appropriate eyelets, then folds the base area about fold line 69 to adhere the two halves of the base area together with the end of the tongue sandwiched between them.

It will be understood that other shapes may be used for the tamper indicating label if desired, such as circular, oval or other shapes for the base area.

Figure 5:
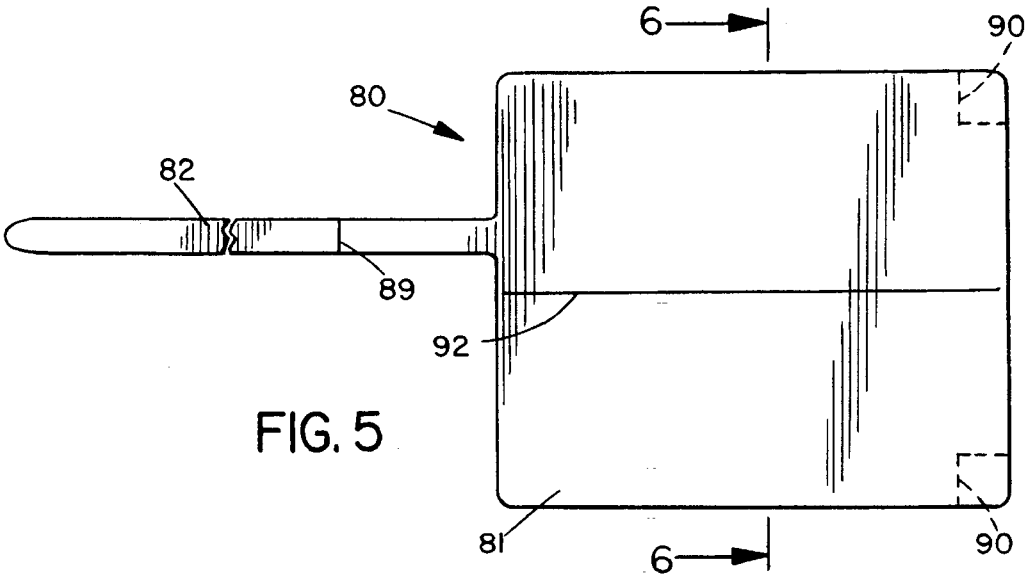
FIG. 5 is a rear view of a further configuration of the tag.
Figure 6:
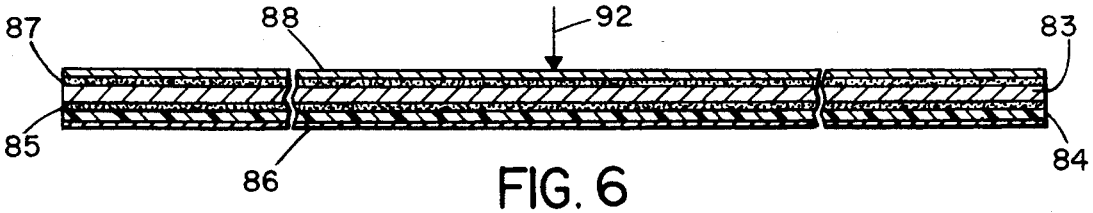
FIG. 6 is an enlarged sectional view taken on line 6—6 of FIG. 5.

FIGS. 5 and 6 illustrate a tamper indicating label or tag 80 according to another embodiment of the invention. In this embodiment, the label 80 is a multi-layer laminate cut to form a base area 81 and an elongate tongue 82 of similar shape to the first embodiment. The laminate comprises a layer 83 of white, chrome-coated paper having a layer 84 of clear polyester laminated on top of the paper layer via adhesive 85, and a clear varnish coating 86 on top of polyester layer 84. The paper layer 83 is backed with a layer of pressure-sensitive adhesive 87 covered with a peel-off paper backing layer 88. Backing layer 88 is provided with a cut or slit 89 in the tongue region, as illustrated in FIG. 5. The adhesive layer 87 does not entirely cover the paper layer in the base area, but two square areas 90 at two corners of the base area are left free of adhesive.

A fold line 92 is provided across the center of the base area, as in the previous embodiments. The white, chrome-coated paper is less tear-resistant than the impregnated paper as used in the first embodiment, but is more suitable for printing, four-color product identification. To make the label more tear-resistant, the surface is covered with polyester layer 84. Coating 86 of an imprintable varnish is added to facilitate a suitable signature area. A suitable signature area (not illustrated) will be imprinted on one half of the base area on coating 86, similar to signature area 20 of the first embodiment. Other indicia may be imprinted on coating 86 as desired. White chrome coated paper is a generic type of paper made by most or all major paper manufacturing companies, including International Paper Co.

When the label 80 is ready to be used, the user first places a signature in the signature area, as in the previous embodiments. The backing layer 88 is then peeled away from the base area and tongue area up to cut 89. The tongue is then threaded through appropriate eyelets as in the previous embodiments, and the base area is folded about line 92 with the exposed adhesive layer 87 innermost. The end of the tongue is placed between the two halves of the base area as they are folded, and the two halves are pressed together with the adhesive layers in face to face engagement and the end of the tongue sandwiched between the two halves. The exposed adhesive region of the tongue up to cut 89 may also be pressed against the opposing region of the tongue to secure these portions of the tongue together for added security.

The tamper indicating label 80 of FIGS. 5 and 6 may thus be used in exactly the same way as that of FIGS. 1–3 and 4 in order to secure any type of container or object having a movable closure. Once the two halves of the base area have been adhered together with the tongue held between them, the label cannot be removed by tearing. The two corner areas 90 which are not coated with adhesive will not be stuck together, and the user can therefore remove the label conveniently by peeling the two halves apart starting at the aligned corners 90. However, this will simultaneously destroy or tear the paper layer, so that the label cannot then be reused.

The dimensions of the base area of the tamper tag in either the first embodiment or that of FIGS. 5 and 6 will be similar to that of a conventional luggage label. The length of the tongue 14,67 or 82 will be sufficient for it to be threaded through the two eyelets and a free end portion sandwiched between the folded halves of the base area, as in FIG. 3. In one example, the base area was around 3.4" by 4.4", and the length of the tongue was 5.75". The signature area will be of sufficient height and length to receive a user's signature. In the illustrated embodiments, the length of area 20 is preferably around 3.2" and the height is around 0.3"–0.4"

The tamper indicating label of the above embodiments is inexpensive and easy to use. It may be readily used with any type of closure or container to be secured, for example a suitcase or briefcase, a drawer of a desk, filing cabinet or other piece of furniture, a jewelry case, a file or folder, a book, a door to a room, cabinet or the like, and so on. In the case of a suitcase or briefcase, the label can also be used as an address label. Once the label has been secured, as generally illustrated in FIG. 3, and the user has applied a signature, it cannot be circumvented by an unauthorized individual without leaving evidence of their tampering. This should provide a significant deterrent to unauthorized individuals opening the container or closure, particularly when access to the container is limited to only a few individuals.

Although some preferred embodiments of the invention have been described above by way of example only, it will be understood by those skilled in the field that modifications may be made to the disclosed embodiments without departing from the scope of the invention, which is defined by the appended claims.

I claim:

1. A tamper indicating label, comprising:

a sheet of tear-resistant paper material cut to form an enlarged base area and an elongate tongue of predetermined length and of width less than a transverse dimension of the base area, the tongue extending from the base area and having a free end remote from the base area;

the sheet having a front face having imprinted indicia defining a signature area for receiving a signature, a rear face, and a fold line extending across the base area to divide the base area into two halves; and an adhesive layer on the rear face of the sheet covering at least one half of the base area, whereby the tongue may be extended through eyelets on two parts of a container with a projecting end portion placed against the adhesive layer on one half of the base area, and the base area may be folded inwardly about the fold line with the rear face innermost and the two halves adhered together with the end portion of the tongue held between the two halves.

2. The label as claimed in claim 1, wherein the signature area is provided on one half of the front face, and imprinted indicia defining an address area are provided on the other half of the front face of the base area.

3. The label as claimed in claim 1, wherein the adhesive layer extends over the rear face of the base area and part of the length of the tongue.

4. The label as claimed in claim 3, wherein the adhesive layer extends along at least ⅓ of the length of the tongue.

5. The label as claimed in claim 1, including a peel-off paper backing layer releasably secured to and covering the adhesive layer.

6. The label as claimed in claim 1, wherein the base area is rectangular and has opposite end edges, the tongue extending from one end edge of the base area.

7. The label as claimed in claim 6, wherein the fold line extends between the end edges of the base area and the tongue extends from a location adjacent the fold line.

8. The label as claimed in claim 6, wherein the base area is elongated and the fold line extends transversely across the width of the base area in a direction parallel to the end edges.

9. The label as claimed in claim 1, wherein the paper material comprises paper impregnated with a second component, the second component being selected from the group consisting of: poly-composite material, vinyl, resin and latex.

10. The label as claimed in claim 1, wherein the paper material is chrome-coated paper with a cover layer of imprintable varnish comprising the front face of the sheet.

11. The label as claimed in claim 1, wherein the rear face of the base area includes two opposing corner regions on opposite halves of the base area which are not covered by said adhesive layer.

12. A tamper indicating security assembly, comprising:

a label of tear-resistant paper material cut to form an enlarged base area and an elongated tongue of predetermined length extending from the base area, the tongue having a width less than a transverse dimension of the base area;

the label having a front face with imprinted indicia in the base area forming a signature-receiving area and a rear face; and a layer of adhesive covering at least half of the rear face of the base area;

the tongue comprising means for extending through eyelets on two parts of a container to be secured; and the base area comprising means for folding about a fold line dividing the base area into two halves with the adhesive layer innermost and a projecting end portion of the tongue trapped between the folded halves of the base area to secure the tongue between the adhered halves of the base area.

13. The assembly as claimed in claim 12, including two eyelets for securing to adjacent parts of a container on opposite sides of a container closure line, each eyelet comprising an eyelet layer having a pair of eyelet slits and an eyelet portion between the slits, and an adhesive backing layer for securing all of the eyelet layer apart from the eyelet portion to a surface.

14. The assembly as claimed in claim 13, wherein the eyelet layer is of tear-resistant paper material.

15. The assembly as claimed in claim 14, wherein the eyelet layer includes a plurality of destructive slits surrounding the eyelet portion, whereby the eyelet layer is torn and destroyed on removal from a surface to which it has been previously applied.

16. The assembly as claimed in claim 13, wherein the eyelet layer is of plastic material, and the adhesive backing layer comprises a layer of adhesive backed tape secured to the eyelet layer, the tape being of larger dimensions than the eyelet layer to form a projecting rim surrounding the eyelet layer.

* * * * *